United States Patent [19]

Garver

[11] 4,209,170

[45] Jun. 24, 1980

[54] TENNIS RACKET

[76] Inventor: John P. Garver, 9450 Sharrott Rd., Poland, Ohio 44514

[21] Appl. No.: 886,296

[22] Filed: Mar. 13, 1978

[51] Int. Cl.[2] ..... A63B 49/12

[52] U.S. Cl. ..... 273/73 G

[58] Field of Search ..... 273/73 R, 73 C, 73 D, 273/73 E, 73 F, 73 G, 73 H

[56] References Cited

U.S. PATENT DOCUMENTS

| | | | |
|---|---|---|---|
| 1,186,283 | 6/1916 | Coddington | 273/73 H |
| 3,612,526 | 10/1971 | Brull | 273/73 G X |
| 3,702,701 | 11/1972 | Vaughn et al. | 273/73 H |
| 3,814,423 | 6/1974 | Shockley et al. | 273/73 C |
| 3,912,268 | 10/1975 | Robinson | 273/73 H |
| 3,981,502 | 9/1976 | Portz | 273/73 G |

FOREIGN PATENT DOCUMENTS

| | | | |
|---|---|---|---|
| 252480 | 6/1926 | United Kingdom | 273/73 H |

OTHER PUBLICATIONS

"The Sporting Goods Dealer", Feb. 1974.

*Primary Examiner*—Richard J. Apley
*Attorney, Agent, or Firm*—Webster B. Harpman

[57] ABSTRACT

A tennis racket construction comprising a frame having an ovaloid head portion terminating in a pair of closely spaced parallel extensions which are adapted to receive a handle with the head portion of the frame being defined by the oppositely curving portions of the frame. A throat made of a resilient elastomeric material is positioned between the oppositely curving portions of the frame to complete the ovaloid shape of the head of the racket and to provide the sole support for adjoining strings attached thereto.

2 Claims, 2 Drawing Figures

TENNIS RACKET

BACKGROUND OF THE INVENTION (1) Field of the Invention

This invention relates to tennis rackets of the type having metal frames such as those formed of aluminum extrusions and throat portions positioned between adjacent portions thereof to complete the typical oval shape of the head.

(2) Description of the Prior Art

Prior rackets of this type may be seen in U.S. Pat. Nos. 3,702,701, 3,814,423 and 3,912,268.

In U.S. Pat. No. 3,702,701 a plastic throat takes the form of a member having a transverse arcuate curve in its area to which the strings are attached, elongated oppositely curved side portions which engage substantial areas of the metal frame and a deep centrally disposed cutaway area therebetween to form a relatively rigid structure.

The present invention discloses a throat with an arcuate curving area adjacent the strings relatively short oppositely disposed curving portions joining the metal frame and a wide cutaway area therebetween, the ends of which extend upwardly into the body of the throat in relatively widely spaced relation so as to form a flexible yet strong throat in the tennis racket.

U.S. Pat. No. 3,814,423 discloses a plastic throat wherein the cutaway area between the oppositely curving ends is transversely straight so that the arcuate curve of the end of the part adjoining the strings forms an area of smallest thickness in the throat midway between the oppositely disposed curving sides thereof.

In the present invention the cutaway area in the throat is so formed as to define two relatively narrow areas in the throat substantially spaced outwardly from a thick central portion thereof.

U.S. Pat. No. 3,912,268 discloses a plastic throat in a tennis racket with its upper and lower areas defining oppositely disposed transverse curves so that the thinnest cross sectional area of the throat is midway between the sides thereof where it joins the metal frame of the racket.

In the present invention the cutaway area in the throat is shaped to provide a thicker cross sectional area midway between the sides of the throat with spaced thinner sections of the throat on either side thereof.

SUMMARY OF THE INVENTION

An improved tennis racket having a metal frame and a plastic throat wherein the throat is relatively thick in its center section and relatively thinner on either side thereof as defined by a cutaway section extending inwardly from the part thereof opposite the strings of the racket. The configuration of the plastic throat is such that the relatively thin areas thereof form areas capable of a large degree of flexability with the result that the frame can flex and acquire an increased and valuable resiliency characteristic which is useful in driving and controlling a ball engaged by the tennis racket.

DESCRIPTION OF THE PREFERRED EMBODIMENT

Figure 1:
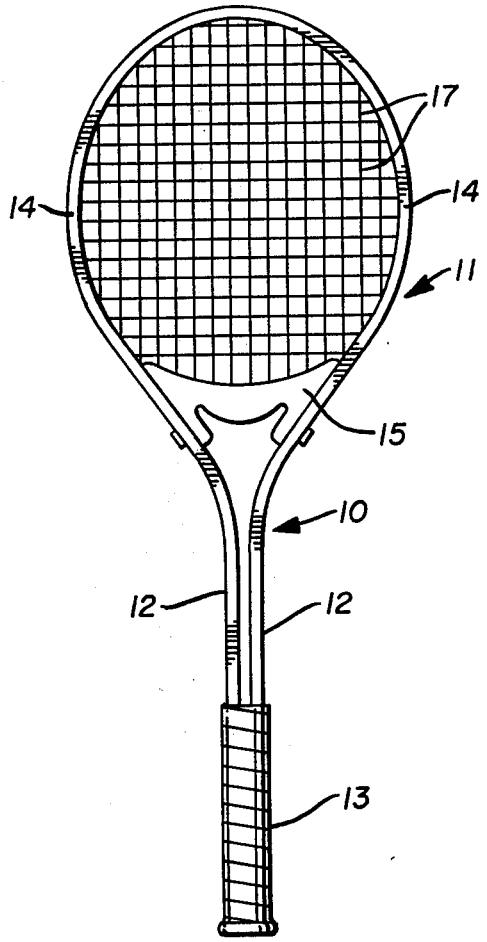
FIG. 1 is a plan view of the tennis racket incorporating the improved throat.

By referring to the drawings and FIG. 1 in particular it will be seen that in the form of the invention chosen for illustration and description herein the racket comprises a frame 10 having an approximately oval shaped or ovaloid head portion 11 terminating in a pair of closely spaced parallel extensions 12 which are held in position by a handle 13 which may be molded plastic and is preferably covered with a resilient continuous wrapping as seen in FIG. 1 of the drawings.

Figure 2:
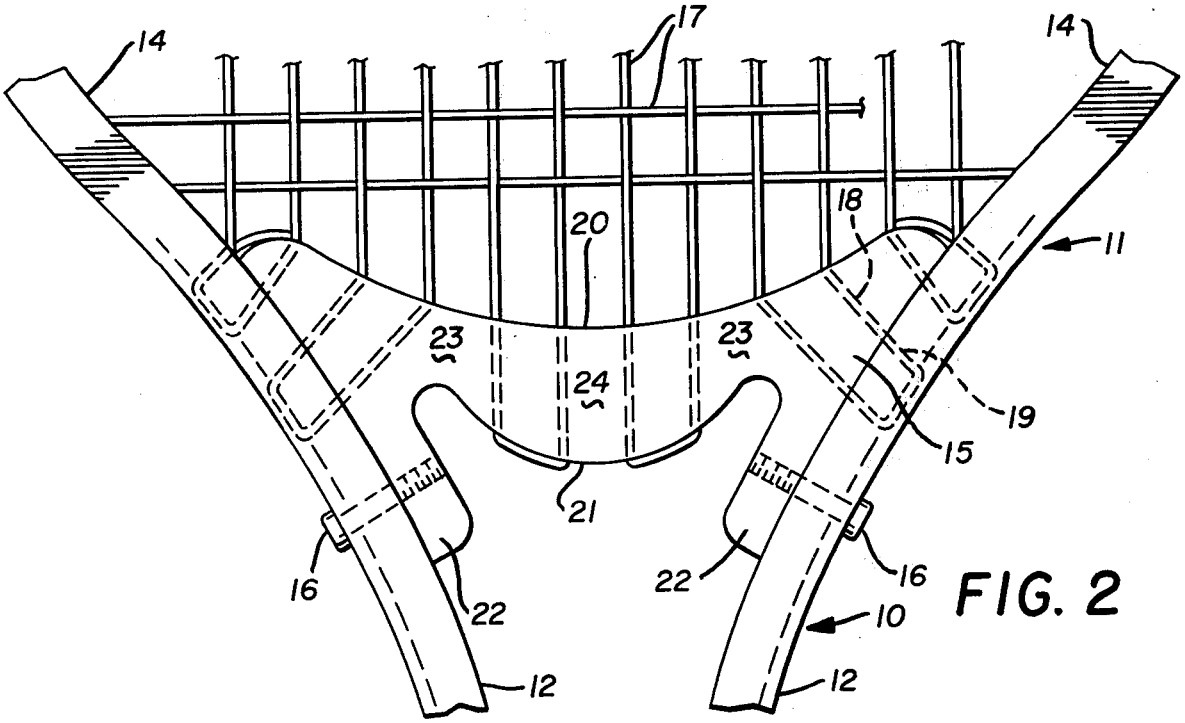
FIG. 2 is an enlarged plan view of a portion of the racket seen in FIG. 1 of the drawings.

The ovaloid head portion 11 is defined by a pair of oppositely disposed curved portions 14 of the frame 10 and the frame 10, the parallel extensions 12 and the curved portions 14 thereof are preferably formed of a continuous metal channel shape such as an aluminum extrusion. The ovaloid shape of the head portion 11 of the tennis racket is completed by a throat 15 which is preferably made of a resilient elastomeric material and as best seen in FIG. 2 of the drawings is positioned between the lower sections of the oppositely curved portions 14 by fasteners 16. The throat 15 is additionally secured to the lower sections of the curved portions 14 of the tennis racket by engagement of the strings 17, some of which are positioned through drilled openings 18 in the opposite ends of the throat 15 so as to register with openings 19 in the oppositely curving portions 14 of the frame 10.

Still referring to FIG. 2 of the drawings, it will be seen that the throat 15 is formed so that its upper surface 20 defines an elongated concave curve while its lower surface 21 has a shortened convex curved section extending between oppositely disposed extensions 22 on the opposite ends of the throat 15. The curvature of the shortened convex curved section 21 is greater than the curvature of the elongated concave curve 20 of the upper surface of the throat so that a pair of relatively widely spaced narrow portions 23 are formed adjacent the ends of the throat 15 and the middle portion 24 of the throat 15 is of relatively greater thickness than the portions 23.

The structure just described and in particular the configuration of the throat 15 results in a firm yet flexible joining of the lower sections of the curved portions 14 of the frame 10 while at the same time providing a strong structural member to which the strings 17 of the racket may be secured and held in desired tensioned relation.

The unique configuration of the throat 15 and in particular the areas 23 thereof which are smaller than the intermediate area 24 thereof permit the lower sections of the oppositely curved portions 14 of the head of the racket to move with respect to one another and this results in a novel resiliency in the racket which extends into the parallel extensions 12 of the frame 10 thereof. The resiliency and flexibility of the racket formed in accordance with this invention contributes greatly to the control of the tennis ball and the imparting thereto of a desired directional flight and force resulting in controlled travel thereof. The throat 15 is preferably formed of acrylic synthetic resin of uniform thickness with flat opposite surfaces with the thickness being less than the thickness of the frame 10.

Although but one embodiment of the present invention has been illustrated and described, it will be apparent to those skilled in the art that various changes and modifications may be made therein without departing from the spirit of the invention and having thus described my invention what I claim is:

1. A tennis racket comprising a frame having an ovaloid head portion terminating in a pair of closely spaced parallel extensions, said head portion being defined by pair of oppositely curving portions of said frame and a throat positioned between said oppositely curving portions and means securing said throat thereto, said oppositely curving portions and said throat providing support for adjoining stringing extending thereacross, said throat comprising a single elongated member having an outwardly curving shape with respect to said stringing, said single elongated member having short curved extensions on its opposite ends engaging said oppositely curving portions of said frame, the middle portion of said single elongated member being thicker than said end portions thereof adjacent said extensions so as to form a single flexible connection between said oppositely curving portions of said frame.

2. The tennis racket set forth in claim 1 and wherein said single elongated member comprising said throat has the inward surface thereof adjoining said stringing defining an elongated concave curve with respect to said stringing throughout a majority of its length and wherein the opposite outward surface thereof with respect to said stringing is formed in a convex curve terminating inwardly of the ends of said single elongated member adjacent said extensions on its ends so as to define said middle portion and wherein the degrees of curvature are different.

* * * * *